US010738781B2

(12) United States Patent
Johnson et al.

(10) Patent No.: US 10,738,781 B2
(45) Date of Patent: Aug. 11, 2020

(54) ACTIVE CLEARANCE MANAGEMENT IN SCREW COMPRESSOR

(71) Applicant: TRANE INTERNATIONAL INC., Davidson, NC (US)

(72) Inventors: Jay H. Johnson, Houston, MN (US); Steven Lotspaih, Onalaska, WI (US)

(73) Assignee: TRANE INTERNATIONAL INC., Davidson, NC (US)

( * ) Notice: Subject to any disclaimer, the term of this patent is extended or adjusted under 35 U.S.C. 154(b) by 0 days.

(21) Appl. No.: 16/568,985

(22) Filed: Sep. 12, 2019

(65) Prior Publication Data

US 2020/0003214 A1 Jan. 2, 2020

Related U.S. Application Data

(62) Division of application No. 15/564,654, filed as application No. PCT/US2016/026204 on Apr. 6, 2016.

(60) Provisional application No. 62/143,294, filed on Apr. 6, 2015.

(51) Int. Cl.

| | |
|---|---|
| ***F04C 28/22*** | (2006.01) |
| ***F25B 1/047*** | (2006.01) |
| ***F04C 18/16*** | (2006.01) |
| ***F01C 21/02*** | (2006.01) |
| ***F25B 49/02*** | (2006.01) |

(52) U.S. Cl.

CPC ..... *F04C 28/22* (2013.01); *F01C 21/02* (2013.01); *F04C 18/16* (2013.01); *F25B 1/047* (2013.01); *F25B 49/022* (2013.01); *F04C 2240/20* (2013.01); *F04C 2240/30* (2013.01); *F04C 2240/50* (2013.01); *F04C 2240/56* (2013.01); *F04C 2270/175* (2013.01); *F25B 2700/2115* (2013.01)

(58) Field of Classification Search

CPC .... F04C 28/22; F04C 2240/56; F25B 49/022; F25B 2700/2115; F01C 21/02

See application file for complete search history.

(56) References Cited

U.S. PATENT DOCUMENTS

| | | | |
|---|---|---|---|
| 4,983,106 | A | 1/1991 | Wright et al. |
| 5,142,175 | A | 8/1992 | Watanabe |
| 5,197,861 | A | 3/1993 | Maruyama et al. |
| 5,310,311 | A | 5/1994 | Andres et al. |
| 5,775,117 | A | 7/1998 | Shaw |

(Continued)

FOREIGN PATENT DOCUMENTS

| | | |
|---|---|---|
| EP | 0867628 | 9/1998 |

OTHER PUBLICATIONS

International Search Report, International Patent Application No. PCT/US2016/026204, dated Jul. 15, 2016 (13 pages).

*Primary Examiner* — Nelson J Nieves

(74) *Attorney, Agent, or Firm* — Hamre, Schumann, Mueller & Larson, P.C.

(57) ABSTRACT

A compressor includes a housing defining a working chamber. The housing further includes a bore and an endplate disposed toward a discharge end. The compressor further includes a rotor having helical threads, the rotor being configured to be housed in the bore, a rotor clearance, a controllable bearing supporting the rotor, and a controller configured to control the controllable bearing such that the controllable bearing moves the rotor in a manner to reduce and/or enlarge the rotor clearance.

8 Claims, 9 Drawing Sheets

(56) References Cited

U.S. PATENT DOCUMENTS

| | | | | |
|---|---|---|---|---|
| 5,857,348 | A | 1/1999 | Conry | |
| 5,924,847 | A | 7/1999 | Scaringe et al. | |
| 6,608,418 | B2 | 8/2003 | Andres et al. | |
| 7,614,844 | B2 | 11/2009 | Schofield | |
| 7,963,748 | B2 | 6/2011 | Taniguchi et al. | |
| 8,186,945 | B2 | 5/2012 | Bhatnagar et al. | |
| 8,330,311 | B2 | 12/2012 | Ramsey et al. | |
| 8,925,197 | B2 | 1/2015 | Royal et al. | |
| 2007/0186578 | A1 | 8/2007 | Lee | |
| 2009/0232691 | A1 | 9/2009 | Van Leuven et al. | |
| 2010/0164422 | A1* | 7/2010 | Shu ..... | H02K 21/029 318/540 |
| 2010/0329916 | A1 | 12/2010 | Yoshimura et al. | |
| 2011/0014079 | A1 | 1/2011 | Pauwels et al. | |
| 2013/0101390 | A1 | 4/2013 | Nachtergaele et al. | |
| 2013/0301967 | A1 | 11/2013 | Schulz et al. | |
| 2014/0216087 | A1 | 8/2014 | Sishitla | |
| 2014/0341770 | A1 | 11/2014 | Hauser et al. | |
| 2015/0030490 | A1 | 1/2015 | Beekman | |
| 2015/0071804 | A1 | 3/2015 | Parsons et al. | |
| 2015/0152731 | A1 | 6/2015 | Yamashita et al. | |
| 2018/0073508 | A1 | 3/2018 | Brady et al. | |

* cited by examiner

ACTIVE CLEARANCE MANAGEMENT IN SCREW COMPRESSOR

FIELD

This disclosure relates to apparatuses, systems, and methods to actively manage one or more rotor clearances in a compressor. More specifically, a controllable bearing, e.g., magnetic bearing, is used to actively manage rotor clearances of a screw compressor.

BACKGROUND

A screw compressor is a type of compressor that can be used to compress various working fluids, such as refrigerant vapor. The screw compressor typically includes one or more rotors. During operation, the working fluid, e.g., refrigerant vapor, can be compressed in a compression chamber while the rotors are rotating.

SUMMARY

Embodiments of apparatuses, systems, and methods that may actively manage one or more rotor clearances in a compressor are described herein. More specifically, a controllable bearing, e.g., magnetic bearing, is used to actively manage a clearance of a screw compressor.

A controllable bearing is defined as a bearing that can move a supported load, e.g., a rotor and/or a shaft, in any one, two, or three dimensional directions. One example of a controllable bearing is a magnetic bearing. A magnetic bearing is defined as a bearing that supports a load, e.g., a rotor, using magnetic levitation. A magnetic bearing may move a supported load in any one, two, or three dimensional directions by changing a force, e.g., magnetic field, of the magnetic levitation. A clearance is defined to be a certain distance, e.g., a gap, between a rotor and another part of a compressor. Different rotor clearances may exist in a compressor, e.g., rotor-to-bore, rotor-to-endplate, rotor-to-rotor, or the like.

Active management of one or more clearances in a compressor at different operation conditions may provide different advantages. For example, a larger clearance may provide mechanical stability to a compressor at a start-up stage when the temperature of the compressor is relatively low compared to a regular operational stage. In another example, a smaller clearance may provide higher compression efficiency to a compressor at a regular operational stage, e.g., non-start-up stage, when the temperature of the compressor is relatively high compared to a start-up stage.

In an embodiment, a compressor that can actively manage a clearance includes a housing defining a working chamber. In an embodiment, the housing includes a bore and an endplate disposed toward a discharge end. The compressor includes a rotor having helical threads, wherein the rotor is configured to be housed in the bore. The compressor includes a rotor-to-bore clearance defined between the rotor and an interior surface of the bore. The compressor may further include a rotor-to-endplate clearance defined between the rotor and the endplate. The compressor includes a controllable bearing that supports the rotor. The compressor includes a controller configured to control the controllable bearing such that the controllable bearing moves the rotor in a manner to reduce and/or enlarge the rotor-to-bore clearance and/or rotor-to-endplate clearance.

In an embodiment, a compressor that can actively manage a clearance includes a housing defining a working chamber. In an embodiment, the housing includes two or more generally parallel but partially intersecting bores and an endplate disposed toward a discharge end. In an embodiment, the compressor includes two or more rotors having intermeshing helical threads, the rotors being configured to be housed in the bores. The compressor includes a first clearance defined between the two rotors, a second clearance defined between one of the rotors and an interior surface of the bores, and a third clearance defined between one of the rotors and the endplate. The compressor includes a controllable bearing supporting one of the rotors, the controllable bearing being configured to be able to move the rotor it supports in a manner to reduce or enlarge the first, second, and/or third clearance. In an embodiment, movement of the rotor(s) is while the compressor is energized or powered on and/or during operation. The compressor includes a controller configured to control the controllable bearing such that the controllable bearing moves the rotor in a manner to reduce and/or enlarge the rotor-to-bore clearance and/or rotor-to-endplate clearance. In an embodiment, the compressor can include a fixed bearing supporting another of the rotors.

In an embodiment, a heating, ventilation, and air conditioning (HVAC) system that can actively manage a clearance in a compressor includes a fluid circuit. The fluid circuit includes a condenser, an expansion device disposed downstream of the condenser, an evaporator disposed downstream of the expansion device, a compressor disposed downstream of the evaporator and upstream of the condenser. The compressor includes a housing defining a working chamber. The housing includes two or more generally parallel but partially intersecting bores and an endplate disposed toward a discharge end. The compressor includes two rotors having intermeshing helical threads, the rotors being configured to be housed in the bores. The compressor includes a first clearance defined between the two rotors, a second clearance defined between one of the rotors and an interior surface of the bores, a third clearance defined between one of the rotors and the endplate. The compressor includes a controllable bearing supporting one of the rotors, the controllable bearing being configured to be able to move the rotor it supports in a manner to reduce or enlarge the first, second, and/or third clearance. In an embodiment, movement of the rotor(s) is while the compressor is energized or powered on and/or during operation. The compressor includes a controller configured to control the controllable bearing such that the controllable bearing moves the rotor in a manner to reduce and/or enlarge the rotor-to-bore clearance and/or rotor-to-endplate clearance. In an embodiment, the compressor can include a fixed bearing supporting another of the rotors.

A method to actively manage a compressor includes determining an operation condition of the compressor, setting a clearance, and moving a rotor according to the set clearance.

DETAILED DESCRIPTION

Figure 1:
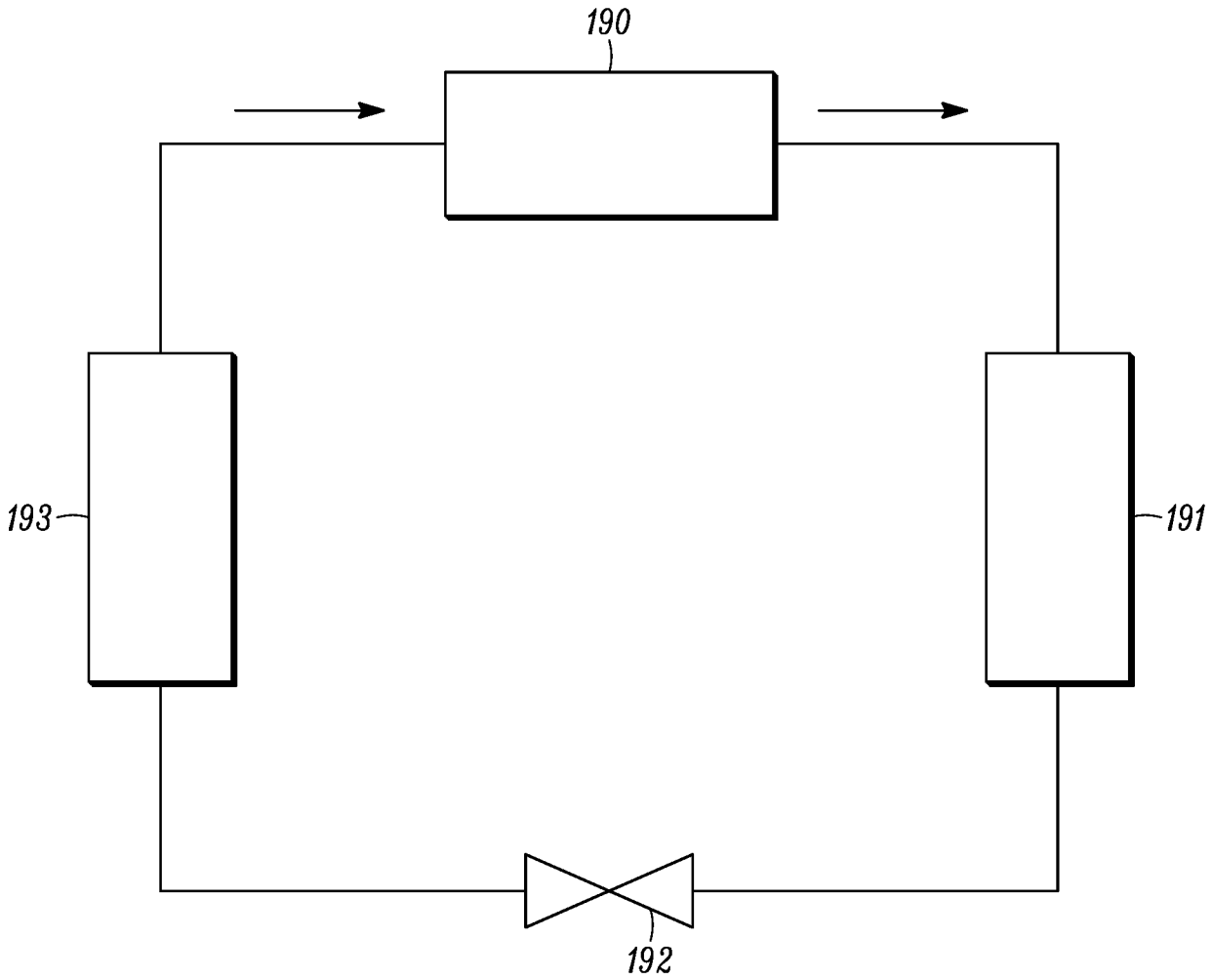
FIG. 1 illustrates a schematic view of a HVAC system, according to one embodiment.

FIG. 1 illustrates a schematic view of a HVAC system, according to one embodiment. As shown in FIG. 1 the HVAC system includes a fluid circuit. Each of the components in the fluid circuit is fluidically connected. The arrows in FIG. 1 indicate the fluid flow. The fluid flow also indicates the upstream and downstream relationships of the components in the fluid circuit. In one example, component A is upstream of B means fluid flows from A to B. In another example, component A is downstream of B means fluid flows from B to A.

As shown in FIG. 1, the HVAC system includes a compressor 190 that compresses a working fluid, e.g. refrigerant, lubricant, vapor, combinations thereof, or the like. The compressor 190 is disposed downstream of an evaporator 193 and upstream of a condenser 191. The condenser 191 is disposed downstream of the compressor 190 and upstream of an expansion device 192. The expansion device 192 is disposed downstream of the condenser 191 and upstream of the evaporator 193. The evaporator 193 is disposed downstream of the expansion device 192 and upstream of the compressor 190. In one embodiment, the compressor 190 may be a screw compressor having at least one rotor. The rotor may be supported by at least one magnetic bearing that can actively manage the rotor clearance of the screw compressor.

Figure 2:
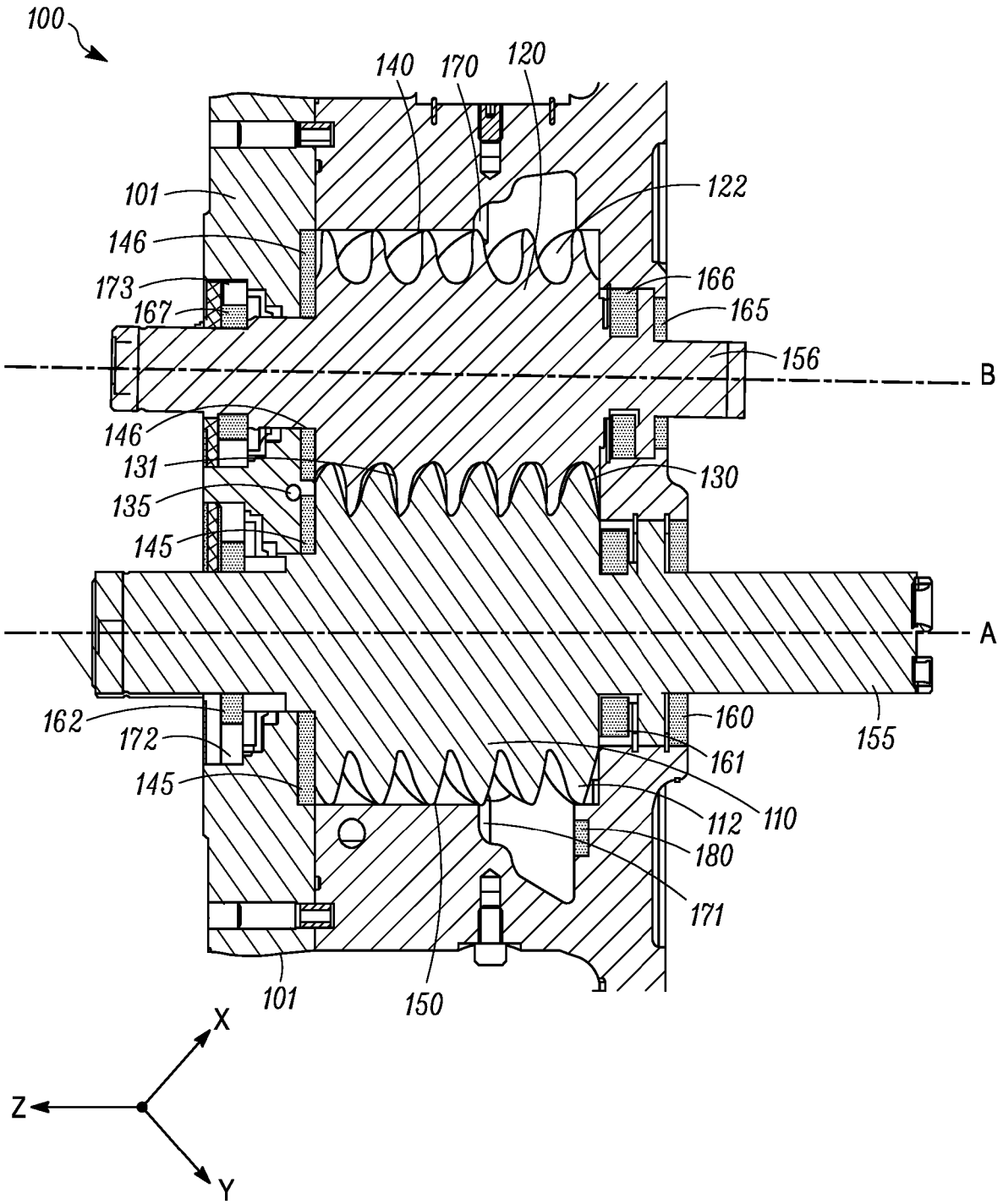
FIG. 2 illustrates a schematic sectional view of a screw compressor, according to one embodiment.

FIG. 2 illustrates a schematic sectional view of a screw compressor 100, according to one embodiment. In one embodiment, the screw compressor 100 can be the compressor 190 in FIG. 1. As shown in FIG. 2, according to an embodiment, the screw compressor 100 includes a housing 101. The housing 101 includes a first bore 150 and a second bore 140. A first rotor 110 is disposed in the first bore 150. A second rotor 120 is disposed in the second bore 140. The first rotor 110 has helical threads 112. The first rotor has a first shaft 155 having a rotational axis A. The second rotor 120 has helical threads 122. The second rotor has a second shaft 156 having a rotational axis B. In an embodiment, the bores 140, 150 are generally parallel but partially intersecting, where one of the axes A and B is slightly angled relative to the other (e.g. axis B is angled relative to axis A). The helical threads 112 on the first rotor 110 intermesh with the helical threads 122 on the second rotor 120. A compression chamber 131 is defined between the helical threads 112, 122 and an interior surface of the housing 101. In one embodiment, the compression chamber 131 may move from an intake port 130 to a discharge port 135 when the first 110 and second 120 rotors rotate. In another embodiment, the compression chamber 131 may continuously reduce its volume while moving from the intake port 130 to the discharge port 135. This continuous reduction of volume compresses the gas or liquid in the compression chamber.

In the embodiment shown, the first rotor 110 is supported by one axial magnetic bearing 160 and two radial magnetic bearings 161, 162. The axial magnetic bearing 160 can move the rotor 110 in a z direction. The radial magnetic bearings 161 and 162 can move the rotor 110 in x-y direction. It should be understood that cooperation of the axial 160 and radial 161, 162 magnetic bearings may move the first rotor 110 in any x-y-z direction so that the rotor-to-bore, rotor-to-endplate, and rotor-to-rotor clearances may be actively managed.

The second rotor 120 is supported by one axial magnetic bearing 165 and two radial magnetic bearings 166, 167. The axial magnetic bearing 165 can move the rotor 120 in a z direction. The radial magnetic bearings 166 and 167 can move the rotor 120 in x-y direction. It should be understood cooperation of the axial 165 and radial 166, 167 magnetic bearings may move the second rotor 120 in any x-y-z direction so that the rotor-to-bore, rotor-to-endplate, and rotor-to-rotor clearances may be actively managed.

In one embodiment, as a result of the active management of the rotor clearances through control of the magnetic bearings 160-162 and 165-167, the rotational axis A of the first shaft 155 may be parallel to the rotational axis B of the second shaft 156. In another embodiment, as a result of the active management of the clearances through the magnetic bearings 160-162 and 165-167, the rotational axis A of the first shaft 155 may not be parallel to the rotational axis B of the second shaft 156

In some embodiments, the housing 101 further includes a discharge end which may be constructed as a first endplate 145 and a second endplate 146. The endplates 145, 146 are disposed at a discharge end. In one embodiment, the endplates 145, 146 are integral parts of the housing 101 disposed at the discharge end, e.g., the flat parts at the end of the housing 101 that face the rotors 110, 120. The endplate 145 is disposed at or about a surface orthogonal to the rotational axis A of the first shaft 155 of the first rotor 110. The endplate 146 is disposed at or about a surface orthogonal to the rotational axis B of the second shaft 156 of the second rotor 120.

In some embodiments, the screw compressor 100 may further include position sensors 170, 171, 172, 173. In one embodiment, the position sensor 170 is disposed on a wall of the second bore 140 and the position sensor 171 is disposed on a wall of the first bore 150. In one embodiment, the position sensors 170 and 171 may sense the position of the rotors 110 and/or 120 relative to the bores 150 and/or 140. The position sensors 170, 171 may be signally, e.g., electrically, connected to a controller, wherein the controller uses the relative positions sensed by the position sensors 170, 171 to control the magnetic bearings 160, 161, 162, 165, 166, 167 to actively manage the clearances of the rotors 110, 120. In one embodiment, the clearances sensed by the position sensors 170, 171, 172, 173 directly can be used to actively manage the clearances. In another embodiment, the positions of rotors sensed by e.g., gap sensors 255, 260, 271, 272, 273, 274 (see e.g. FIGS. 3A and 3B) are used to actively manage the clearances, and the clearances can be indirectly calculated from rotor positions. In yet another embodiment both position sensors 170, 171, 172, 173 and gap sensors 255, 260, 271, 272, 273, 274 can all be used in combination to actively manage the clearances.

In one embodiment, the position sensor 172 is disposed on or close to an inner surface of the endplate 145. In another embodiment, the position sensor 173 is disposed on or close to an surface of the endplate 146. In one embodiment, the position sensors 172 and 173 may sense the position of the rotors 110 and/or 120 relative to the endplates 145, 146. The position sensors 172, 173 may be signally connected to a controller, wherein the controller uses the relative positions sensed by the position sensors 172, 173 to control the magnetic bearings 160, 161, 162, 165, 166, 167 to actively manage the clearances of the rotors 110, 120.

In one embodiment, the clearances may be actively managed by moving only the rotor 110. In another embodiment, the clearances may be actively managed by moving only the rotor 120. In another embodiment, the clearances may be actively managed by moving both the rotors 110 and 120.

It should be understood the active management of rotor clearances is not limited to the embodiment shown in FIG. 2. The number of rotors and the numbers of magnetic bearings may vary. In another embodiment, a screw compressor may have only one rotor, which may be supported by one or more magnetic bearings. In another embodiment, a screw compressor has two or more rotors, but only one of the two rotors is supported by one or more magnetic bearings; the other rotor may be supported by mechanical bearings (e.g., the compressor can include a fixed bearing). In yet another embodiment, as shown in FIG. 2, the screw compressor has two or more rotors 110, 120 and two or more rotors 110, 120 are supported by one or more magnetic bearings.

In another embodiment, the screw compressor 100 may have a temperature sensor 180. It is noted that, the temperature sensor 180 may be disposed on a rotor, on a wall of a bore, on an endplate, at a discharge port, at an intake port, any part of a compressor, and/or any location within the fluid circuit of a HVAC system where a temperature of that location is desired for the active management of clearances. In one embodiment, the temperature sensors 180 may be signally connected to a controller, wherein the controller uses the temperature sensed by the temperature sensors 180 to control the magnetic bearings to actively manage the clearances of the rotors.

A controllable bearing is defined as a bearing that can move a supported load, e.g., a rotor and/or a shaft, in any one, two, or three dimensional directions. One example of a controllable bearing is a magnetic bearing. A magnetic bearing is defined as a bearing that supports a load, e.g., a rotor, using magnetic levitation.

It is noted that this disclosure does not limit the screw compressor configuration to two intermeshing rotors. In one embodiment, the screw compressor may have a single rotor, wherein the helical threads of the single rotor defines the compression chamber against some other moving or static components of the screw compressor. In another embodiment, a screw compressor has three intermeshing rotors, e.g. one male and two female rotors, or one male and two gate rotors (one on each side of the male rotor at or about 90 degrees to axis of the male rotor), and the like. In yet another embodiment, a screw compressor has four intermeshing rotors, e.g., two male and two female rotors, etc.

It is further noted that the above mentioned embodiment of a screw compressor having one male rotor and two gate rotors can also be recognized as single rotor screw compressor by a person having ordinary skill in the art. A single rotor screw compressor is a screw compressor that has at least one rotor with helical threads or one helical rotor. In one embodiment, a single rotor screw compressor may include one rotor with helical threads and at least one gate rotor. The at least one gate rotor may have gears that intermesh with the helical threads of the rotor to define a compression chamber. The at least one gate rotor may have a rotational axis disposed at an angle of 90 degrees relative to the rotational axis of the rotor. The apparatuses and methods disclosed herein can also be applied in a single rotor screw compressor.

Figure 3A:
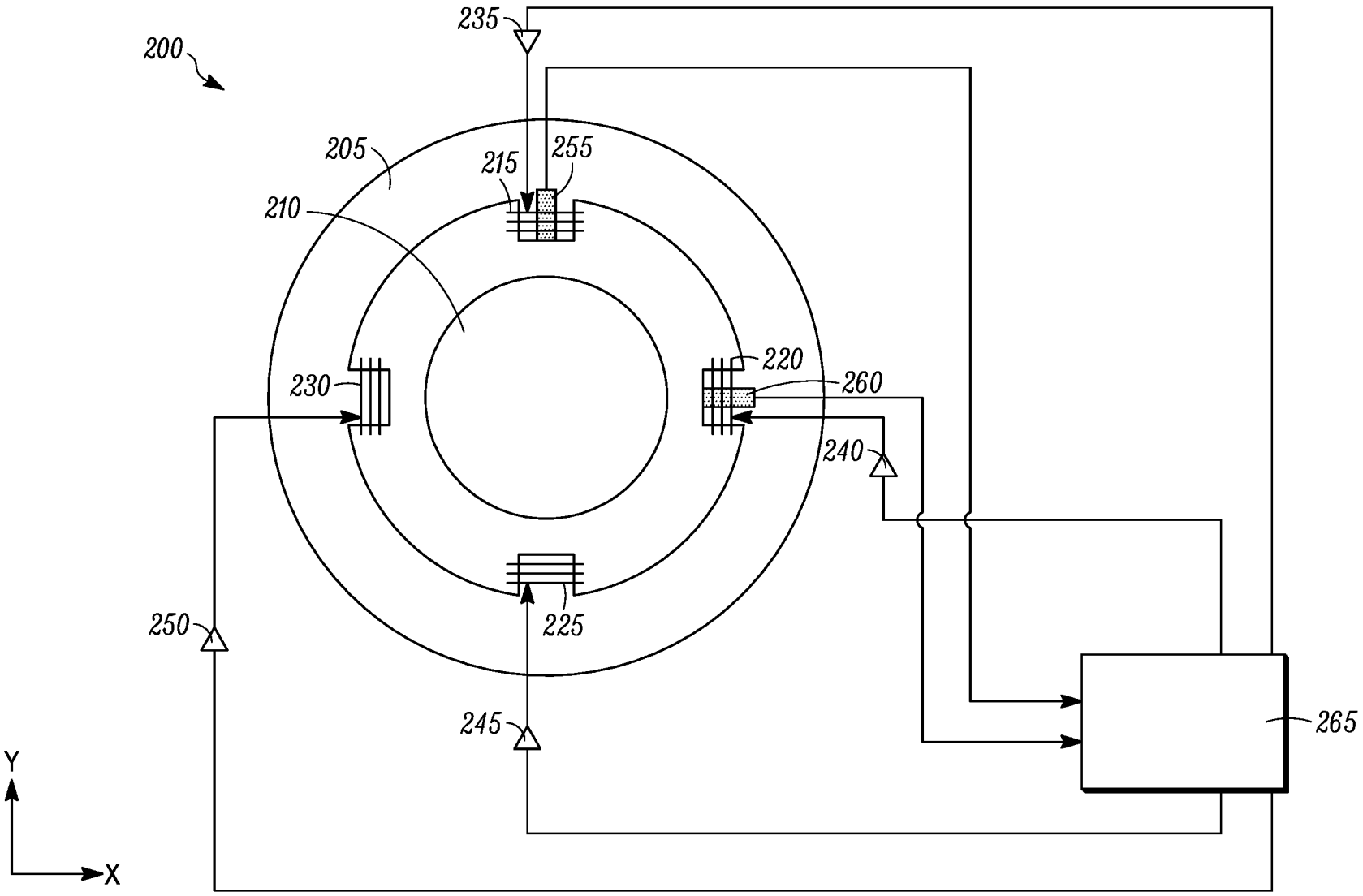
FIG. 3A illustrates a schematic sectional view of a radial magnetic bearing, according to one embodiment.

FIG. 3A illustrates a schematic sectional view of a radial magnetic bearing 200, according to one embodiment. In one embodiment, the radial magnetic bearing 200 can be the radial bearing 161, 162, 166, or 167 in FIG. 2. In another embodiment, the shaft 210 can be the shaft 155 or 156 in FIG. 2. FIG. 3A shows an example of a radial magnetic bearing 200 used to support a shaft 210 that may be connected to a rotor, e.g., rotors 110, 120 in FIG. 2. As shown in FIG. 3A, the radial magnetic bearing 200 includes a stator 205. The stator 205 can be static and configured to stay in a fixed position in relation to a housing of a compressor, contrary to the shaft 210 which can make relative movements. The shaft 210 may be connected to, e.g., a rotor, to support its rotation. As shown in FIG. 3A, the radial magnetic bearing further includes four electromagnets 215, 220, 225, 230. It is noted that the magnetic bearing 200 may have more or less than four electromagnets. The electromagnets 215, 220, 225, 230 can produce the suitable magnetic levitation to support the bearing load, e.g., the weight of a rotor. The radial magnetic bearing 200 further includes amplifiers 235, 240, 245, 250. The amplifiers 235, 240, 245, 250 can generate suitable electric currents for the electromagnets 215, 220, 225, 230. The magnetic bearing 200 further includes a first 255 and a second 260 gap sensor. The gap sensors 255, 260 sense a gap between the shaft 210 and the stator 205 in an x-y plane. In other words, the gap sensors 255, 260 sense a location of the shaft 210 in relation to stator 205 in an x-y plane. The relative locations between the shaft 210 and the stator 205 in the x-y plane are not the rotor-to-bore and/or rotor-to-rotor clearances which are the relative locations between a rotor and bore, or a rotor and another rotor, e.g., the clearances of the rotors 110, 120 in FIG. 2. However, the relative locations between the shaft 210 and the stator 205 in the x-y plane may be used to calculate the rotor-to-bore and/or rotor-to-rotor and/or rotor-to-endplate clearances indirectly.

Figure 3B:
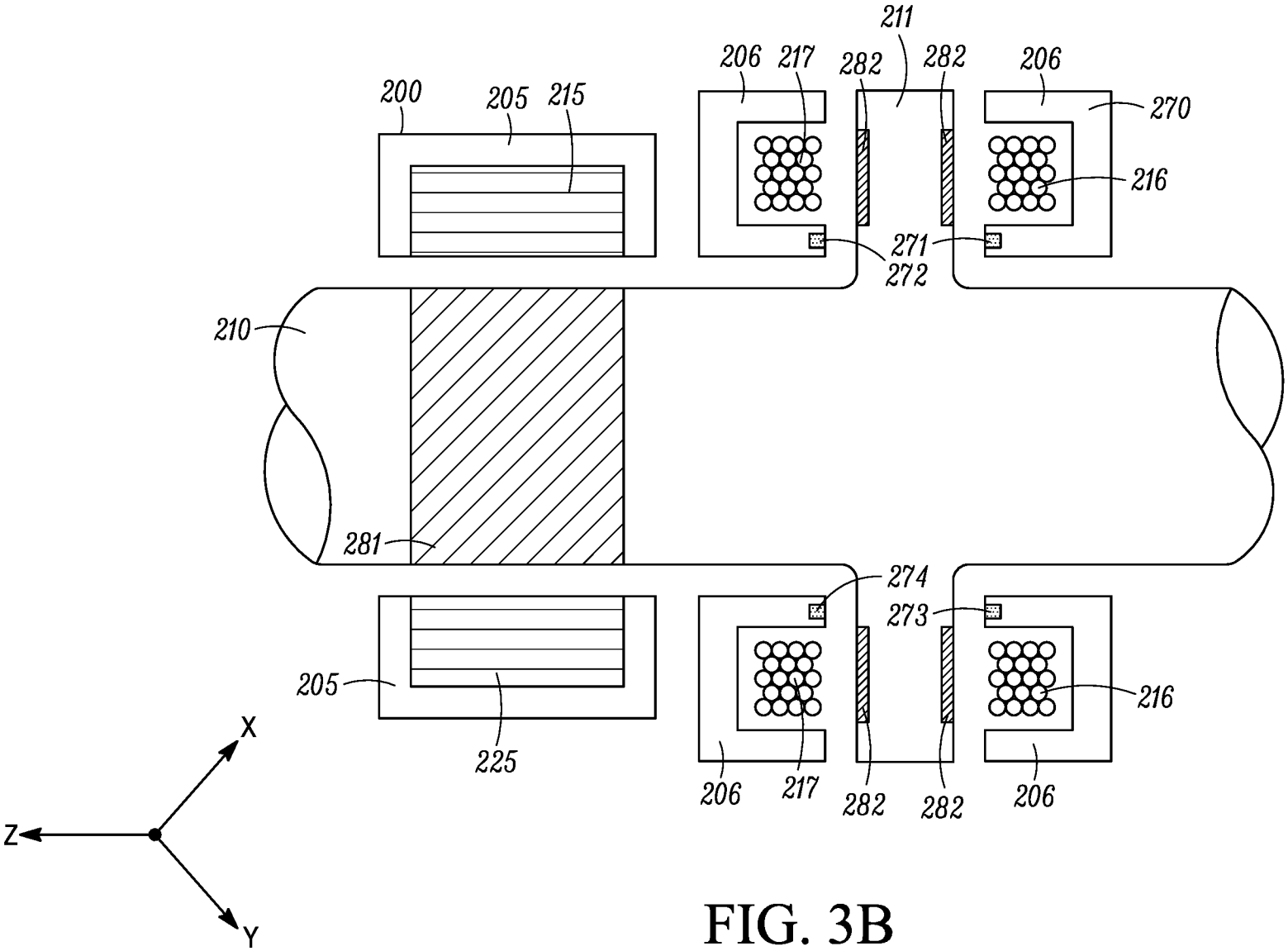
FIG. 3B illustrates a schematic side view of a radial and an axial magnetic bearing, according to one embodiment.

A controller is defined as a machine or apparatus that has at least one input and one output. The controller determines and executes control decisions through the output according to the input(s). In some embodiments, the input can be a temperature(s) measured at certain positions of a compressor, e.g., rotor, bore, endplate, housing, intake port, discharge port. In some embodiments, the input can be a pressure(s) measured in certain positions of a compressor, e.g., rotor, bore, endplate, housing, intake port, discharge port. In some embodiments, the input can be the relative positions of a shaft and/or a rotor to a static and/or moving part of a compressor, e.g., bore, endplate, another rotor. In one embodiment, the rotor clearances can be measured directly using position sensors 170, 171, 172, 173 in FIG. 2. In another embodiment, the rotor clearances can be calculated indirectly from relative positions between a shaft 210 and a stator 205, 206 as shown in FIGS. 3A and 3B.

FIG. 3A shows an embodiment of a controller 265. The magnetic bearing, as shown in FIG. 3A, further includes a controller 265. The controller 265 receives sensed signals from the gap sensors 255, 260 and sends control signals to the electromagnets 215, 220, 225, 230. The gap sensor 255 may sense the relative position of the shaft 210 to the stator 205, for example, in an x-direction. The gap sensor 260 may sense the relative position of the shaft 210 to the stator 205, for example, in a y-direction. Based on the signal sensed by the gap sensors 255, 260, the controller 265 makes decision(s) to increase or decrease the electromagnetic field produced by the electromagnets 215, 220, 225, and 230. This can form a feedback control loop. In one embodiment, a feedback control loop may operate from 1,000 to 30,000 Hz. In another embodiment, the feedback control loop may operate from 10,000 to 25,000 Hz. In yet another embodiment, the feedback control loop may operate from 15,000 to 20,000 Hz.

The controller 265 may include one or more input/output ports. The controller 265 may include a memory, a processor, and a clock. The controller 265 may be able to make logical determinations according to for example human instructions or machine readable instructions. One example of making a logical determination is that if a certain gap is too small, then a controller controls, e.g., strengthens or weakens, a magnetic field to increase the gap to a workable distance. Or vice versa, if a certain gap is too large, then a controller controls, e.g., strengthens or weakens, a magnetic field to reduce the gap to a workable distance. The controller 265 may be able to execute machine readable instructions or programmed algorithms.

A clearance is defined to be a certain distance, e.g., a gap, between a rotor and another part of a compressor. For example, a rotor-to-rotor clearance can be a distance between one rotor and another rotor in a compressor. In another example, a rotor-to-bore clearance can be a distance between one rotor and an interior surface of a bore in a compressor. In another example, a rotor-to-endplate clearance can be a distance between one rotor and an endplate in a compressor. In one embodiment, a screw compressor may include all three of the rotor-to-rotor, rotor-to-bore, and rotor-to-endplate clearances. In one embodiment, the rotor-to-rotor, rotor-to-endplate, and rotor-to-bore clearances can be measured directly by the position sensors 170, 171, 172, 173. In one embodiment, the rotor-to-bore clearance, rotor-to-rotor, and rotor-to-endplate clearances can be calculated from the relative positions between the shaft 210 and the stator 205, 206 sensed by the gap sensors 255, 260, 271, 272 (see e.g. FIG. 3B) of a radial 200 and axial 270 magnetic bearing.

In one embodiment, in addition to position sensors 170, 171, 172, 173 and/or gap sensors 255, 260, 271, 272 of a radial 200 and axial 270 magnetic bearing, the controller 265 may use the temperature sensed by the temperature sensor 180 to control the radial 200 and/or axial 270 magnetic bearings. For example, if the sensed temperature by the temperature sensor 180 is lower than a threshold temperature, then the controller 265 will change the magnetic levitation of the radial 200 and/or axial 270 magnetic bearings to change the position of the rotor 210, e.g. to have larger clearances. In another example, if the sensed temperature by the temperature sensor 180 is higher than a threshold temperature, then the controller 265 will change the magnetic levitation of the radial 200 and/or axial 270 magnetic bearings to change the position of the rotor 210, e.g. to have smaller clearances. It is noted that the specific movements of the rotor 210 actuated by the controller 265 through the magnetic bearings 200, 270 according to the temperature sensor 180 are not limited to the examples above. Based on different system design, increase and/or decrease of any clearance(s) may be made according to any temperature sensed.

A radial magnetic bearing, such as the magnetic bearing shown in FIG. 3A, may provide a compressor the ability to move a rotation axis of a rotor off-center in any one or two dimensional directions perpendicular to the rotation axis. In another embodiment, as shown in FIG. 2, if two magnetic radial bearings 161, 162 are used to support a rotor 110, the rotation axis A can be tilted with an angle not parallel to the rotation axis B of rotor 120. A radial magnetic bearing may provide active management of rotor-to-rotor and rotor-to-bore clearances.

FIG. 3B illustrates a schematic side view of the radial 200 (which is also shown in FIG. 3A) and the axial 270 magnetic bearing, according to one embodiment. In one embodiment, the radial magnetic bearing 200 in FIGS. 3A and 3B can be the magnetic bearings 161, 162, 166, 167 in FIG. 2. In another embodiment, the axial magnetic bearing 270 can be the axial magnetic bearing 160, 165 in FIG. 2. As shown in FIG. 3B, a radial magnetic bearing 200 includes a stator 205 and one or more electromagnets 215, 225 as shown in FIG. 3A. The stator 205 is disposed around the shaft 210. The shaft 210 may be connected to a rotor of a compressor, e.g., rotors 110, 120 shown in FIG. 2.

As shown in FIG. 3B, an axial magnetic bearing 270 includes a stator 206 and one or more electromagnets 216, 217. The shaft 210 has areas of magnetic lamination 281 so that the shaft 210 makes corresponding movements according to the magnetic forces exerted by the electromagnets 215, 220, 225, 230. The axial magnetic bearing 270 may include one or more gap sensors 271, 272, 273, 274 to sense the relative positions between the shaft disk 211 and the stator 206. In this embodiment, the shaft disk 211 is fixed on the shaft 210, i.e., the shaft 210 and the shaft disk 211 moves and/or rotates together. Similar to the radial magnetic bearing 200, the gap sensors 271, 272, 273, 274 of the axial magnetic bearing 270 are signally (e.g., electrically) connected to the controller 265 as shown in FIG. 3A. The controller 265 may control the electromagnetic fields produced by the electromagnets 216, 217 to move the shaft disk 211 as well as the shaft 210 in the z-direction. The shaft disk 211 has areas of magnetic lamination 282 so that the shaft disk 211 makes corresponding movements according to the magnetic forces exerted by the electromagnets 216, 217. An axial magnetic bearing 270 may provide active management of rotor-to-endplate clearance. Therefore, a compressor including both axial and radial magnetic bearings may have the ability to move a rotor in any three dimensional direction.

In one embodiment, a position sensor 172, 173 disposed near the endplate 145, 146 can be used to sense the rotor-to-endplate clearance directly. In another embodiment, the rotor-to-endplate clearance can be calculated indirectly from the relative positions obtained by the gap sensor 271, 272, 273, 274 between the shaft disk 211 and the stator 206 of an axial magnetic bearing 270. In another embodiment, a position sensor 170, 171 can be used to sense the rotor-to-bore and the rotor-to-rotor clearances directly. In another embodiment, the rotor-to-bore and the rotor-to-rotor clearances can be calculated indirectly from the relative positions between the shaft 210 and the stator 205 of a radial magnetic bearing 200 obtained by the gap sensor 255, 260.

Figure 4:
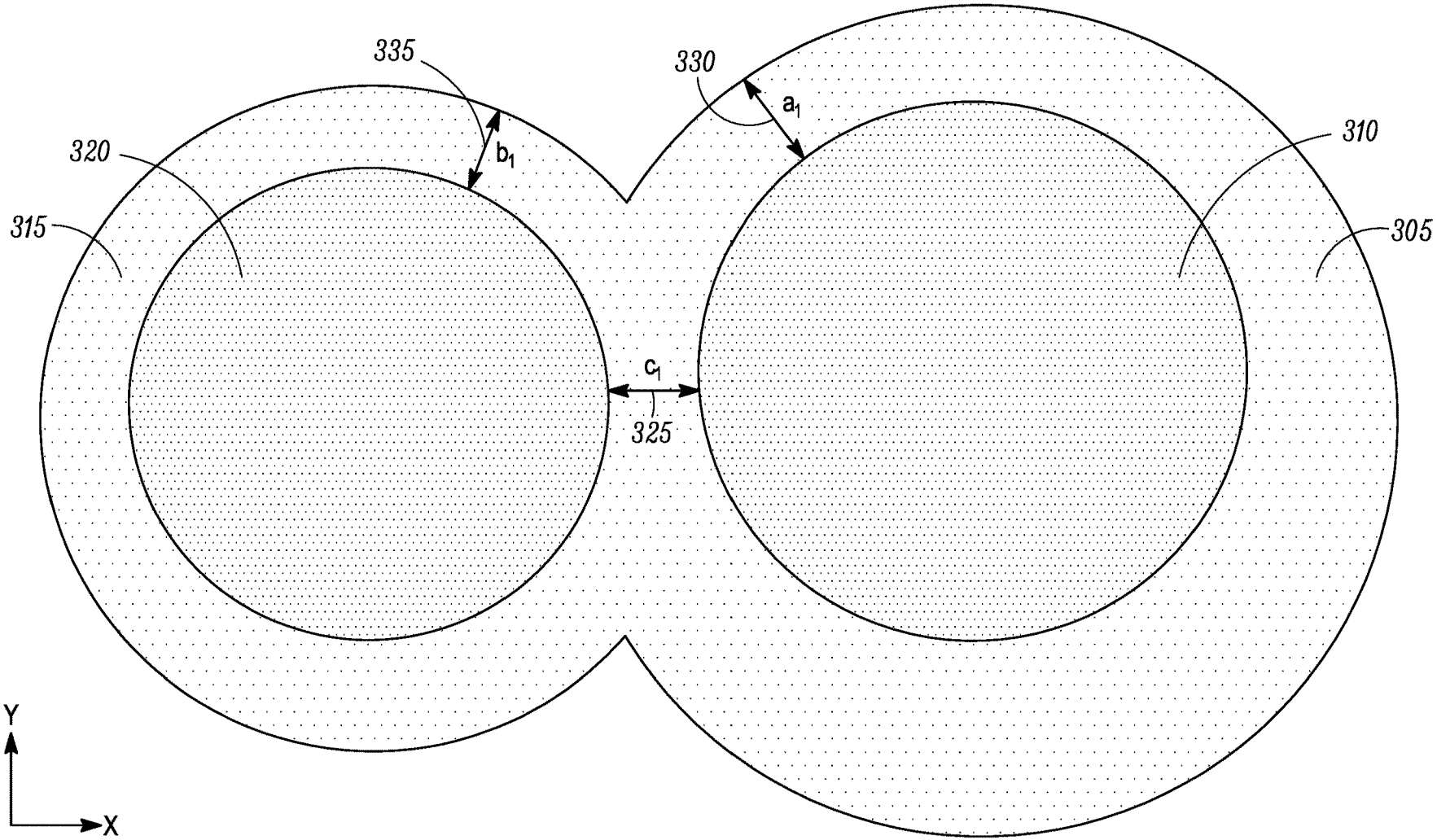
FIG. 4 illustrates a schematic sectional view of a screw compressor with a static, non-controllable bearing showing rotor-to-rotor and rotor-to-bore clearances, according to one embodiment.

FIG. 4 illustrates a schematic sectional view of a screw compressor with a static non-controllable bearing 320, 310 showing rotor-to-rotor $c_1$ and rotor-to-bore $a_1$, $b_1$ clearances during regular operations, according to one embodiment. FIG. 4 shows a sectional view of a screw compressor with a static non-controllable bearing rotor. As shown in FIG. 4, a first rotor 310 is disposed in a first bore 305. A second rotor 320 is disposed in a second bore 315. A first rotor-to-bore clearance 330 has a distance $a_1$ between the first rotor 310 and the first bore 305. A second rotor-to-bore clearance 335 has a distance $b_1$ between the second rotor 320 and the second bore 315. A rotor-to-rotor clearance 325 has a distance $c_1$ between the first rotor 310 and the second rotor 320. In this embodiment, the screw compressor has a non-controllable bearing. Therefore, the distances of the clearances $a_1$, $b_1$, and $c_1$ are fixed and are not changeable. Because the clearances are not changeable, $a_1$, $b_1$, and $c_1$ are set at values that the compressor would workably operate both at start-up stage when the temperature of the compressor is relatively low, and during regular operation when the temperature of the compressor is relatively high. That is, the values of $a_1$, $b_1$, and $c_1$ are not optimized for start-up, or for regular operation of a compressor.

The clearance values in a fixed arrangement as shown in FIG. 4 are a compromise between the needs for startup and the needs for efficient operation. In such a compromise, neither the need for a reliable start-up nor the need for an efficient operation is optimized. On the contrary, active management of clearances using controllable bearings as described in this disclosure may resolve this issue.

One or more temperatures of a compressor are defined to be temperatures measured at certain positions of a compressor, e.g., rotor, bore, endplate, housing, intake port, discharge port, or the like. One or more pressures of a compressor are defined to be pressures measured at certain positions of a compressor, e.g., rotor, bore, endplate, housing, intake port, discharge port, or the like.

During start-up, the temperature of the compressor is low and the pressure difference between the intake port and discharge port is low compared to a non-startup operation. During start-up, the rotor-to-rotor, rotor-to-bore, and rotor-to-endplate clearances should be maintained relatively larger to ensure mechanical reliability. When the compressor runs during regular operation, the temperature of the compressor is higher and the pressure difference between the intake and discharge ports has increased compared to start-up, the rotor-to-rotor, rotor-to-bore, and rotor-to-endplate clearances should be reduced to produce maximum efficiency.

A rotor clearance in a compressor may be actively managed by using, e.g., a controllable bearing or the like. In one embodiment, a screw compressor may have a controllable bearing, e.g., magnetic bearing. In such an example, the rotor-to-rotor, rotor-to-bore, rotor-to-endplate clearance can be actively managed by controlling the controllable bearing. In one embodiment, at a start-up stage of a compressor, a rotor-to-rotor, rotor-to-bore, and/or rotor-to-endplate clearance are managed to maintain relatively larger distances to ensure mechanical reliability.

In another embodiment, when the compressor is in regular operation condition, the temperature of the compressor has increased. In one embodiment, in regular operation, the rotor-to-rotor, rotor-to-bore, and/or rotor-to-endplate clearance may be managed to maintain at relatively smaller distances to ensure efficiency.

In another embodiment, the clearances of rotor-to-rotor, rotor-to-endplate, and rotor-to-bore may be kept at relatively larger distances in response to liquid slugging, low discharge superheat, carryover, etc.

Figure 5:
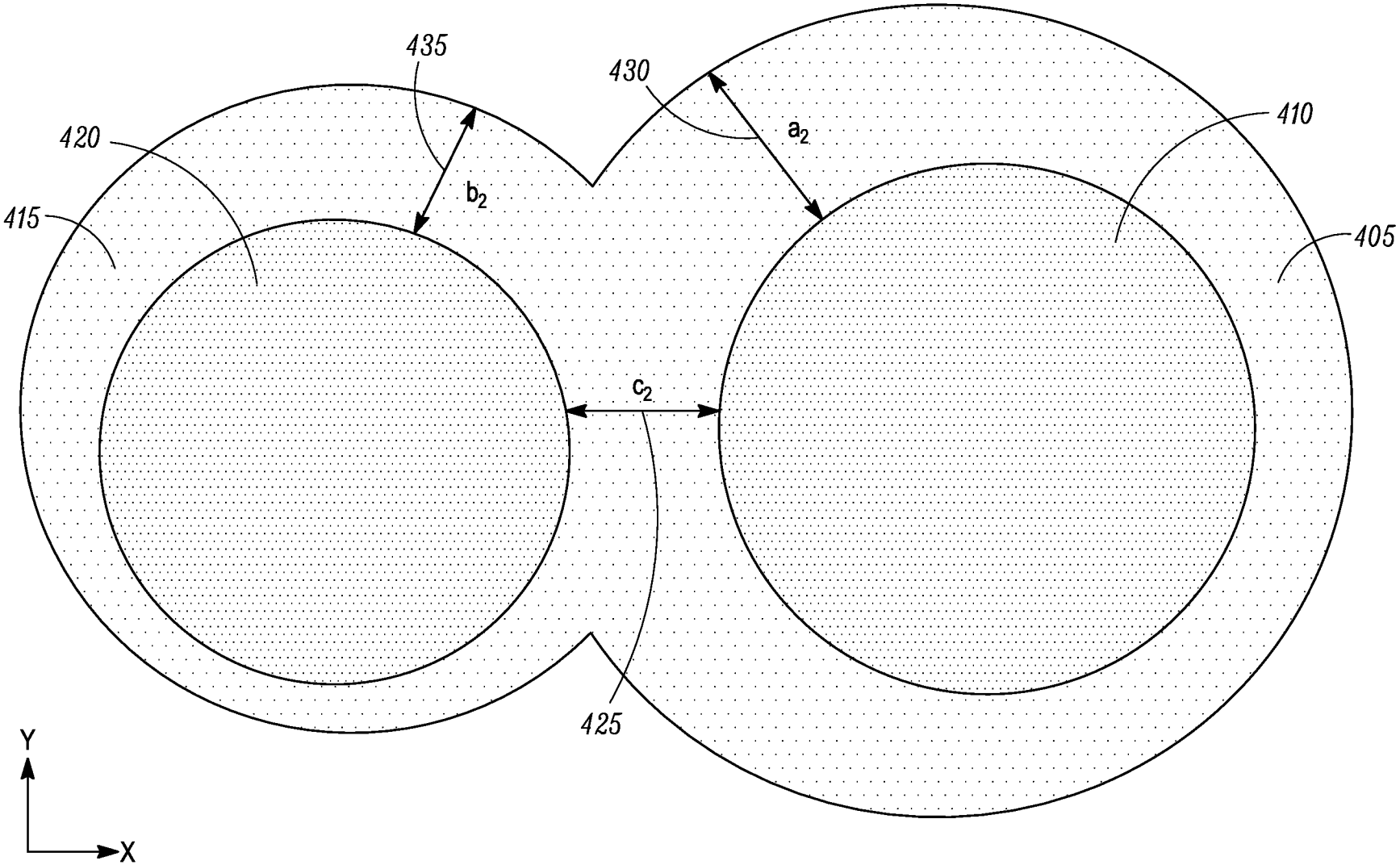
FIG. 5 illustrates a schematic sectional view of a screw compressor with a controllable bearing showing rotor-to-rotor and rotor-to-bore clearances at start-up, according to one embodiment.

FIG. 5 illustrates a schematic sectional view of a screw compressor with a controllable bearing (e.g., magnetic) showing rotor-to-rotor, $c_2$ and rotor-to-bore clearances $a_2$, $b_2$ at start-up, according to one embodiment. In one embodiment, the controllable bearing can be the magnetic bearings 160, 161, 162, 165, 166, 167 in FIG. 2. In another embodiment, the controllable bearings can be the magnetic bearings 200, 270 in FIGS. 3A and 3B. FIG. 5 shows a sectional view of a screw compressor with controllable bearings, e.g., a magnetic bearing. As shown in FIG. 5, a first rotor 410 is disposed in a first bore 405. A second rotor 420 is disposed in a second bore 415. A first rotor-to-bore clearance 430 has a distance $a_2$ between the first rotor 410 and the first bore 405. A second rotor-to-bore clearance 435 has a distance $b_2$ between the second rotor 420 and the second bore 415. A rotor-to-rotor clearance 425 has a distance $c_2$ between the first rotor 410 and the second rotor 420.

In the embodiment shown in FIG. 5, the screw compressor has controllable bearings. Therefore, the first rotor-to-bore 430, the second rotor-to-bore 435, and the rotor-to-rotor 425 clearances are changeable by moving one or two of the rotors 410, 420 in a radial direction. The temperature of the compressor at start-up is usually relatively lower than regular operation. In one embodiment, at start-up, the distances $a_2$, $b_2$, $c_2$ of the clearances may be controlled to be maintained at larger distances such that $a_2>a_1$, $b_2>b_1$, and $c_2>c_1$, wherein $a_1$, $b_1$, and $c_1$ refer back to FIG. 4. These relatively larger clearances may provide mechanical stability when a compressor is starting up.

In another embodiment, a screw compressor may include a rotor-to-endplate clearance (e.g., shown in FIG. 2 the distance between rotor 110, 120 and endplate 145, 146). The rotor-to-endplate clearance may also be maintained at a relatively larger distance to provide a mechanical stability when the compressor is starting up.

Figure 6:
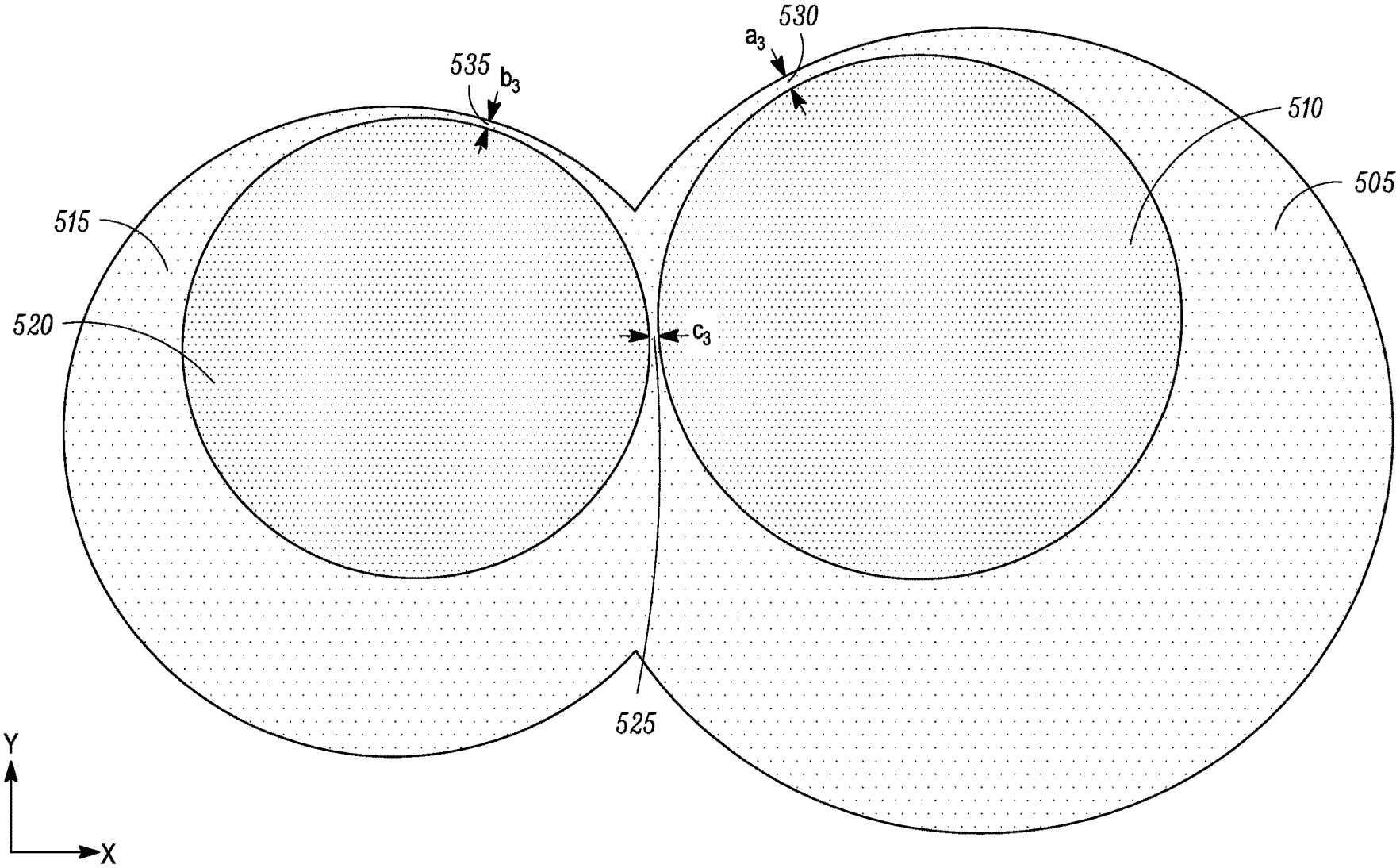
FIG. 6 illustrates a schematic sectional view of a screw compressor with a controllable bearing showing rotor-to-rotor and rotor-to-bore clearances during operation, according to one embodiment.

FIG. 6 illustrates a schematic sectional view of a screw compressor with a controllable bearing showing rotor-to-rotor $c_3$ and rotor-to-bore $a_3$, $b_3$ clearances during regular operation, according to one embodiment. In one embodiment, the controllable bearing can be the magnetic bearings 160, 161, 162, 165, 166, 167 in FIG. 2. In another embodiment, the controllable bearings can be the magnetic bearings 200, 270 in FIGS. 3A and 3B. FIG. 6 shows a sectional view of a screw compressor with a controllable bearing, e.g., a magnetic bearing. As shown in FIG. 6, a first rotor 510 is disposed in a first bore 505. A second rotor 520 is disposed in a second bore 515. A first rotor-to-bore clearance 530 has a distance $a_3$ between the first rotor 510 and the first bore 505. A second rotor-to-bore clearance 535 has a distance $b_3$ between the second rotor 520 and the second bore 515. A rotor-to-rotor clearance 525 has a distance $c_3$ between the first rotor 510 and the second rotor 520.

In the embodiment shown in FIG. 6, the screw compressor has a controllable bearing, e.g. magnetic bearing. Therefore, the first rotor-to-bore 530, the second rotor-to-bore 535, and the rotor-to-rotor 525 clearances are changeable by moving one or two of the rotors 510, 520 in a radial direction. In one embodiment, during regular operation, the distances $a_3$, $b_3$, $c_3$ of the clearances may be controlled to be maintained at smaller distances such that $a_3<a_1$, $b_3<b_1$, and $c_3<c_1$, wherein $a_1$, $b_1$, and $c_1$ refer back to FIG. 4. These relatively smaller clearances may provide higher compression efficiency during regular operation, e.g., not at a start-up stage, of a compressor.

In another embodiment, a screw compressor may include a rotor-to-endplate clearance (e.g., shown in FIG. 2 the distance between rotor 110, 120 and endplate 145, 146). The rotor-to-endplate clearance may also be maintained at a relatively smaller distance to provide higher compression efficiency during regular operation.

Figure 7:
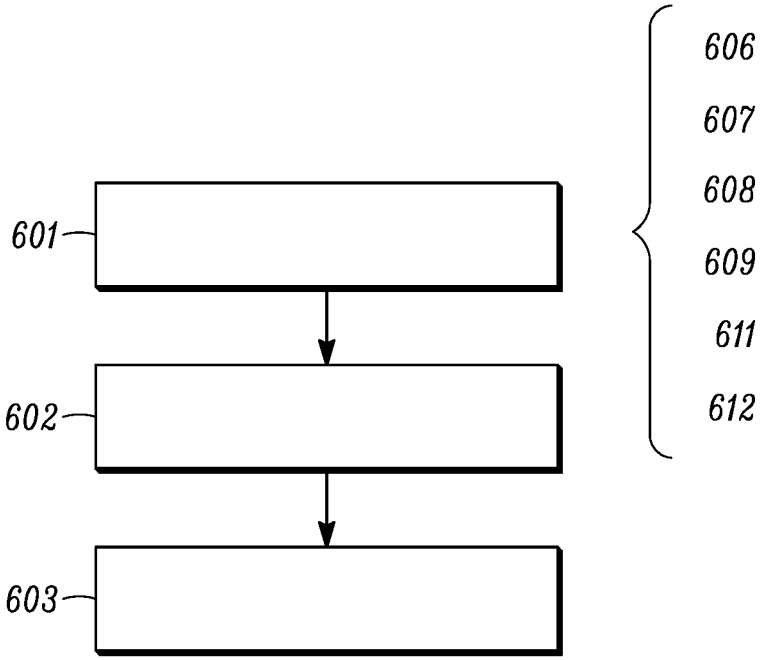
FIG. 7 illustrates a method of active clearance management, according to one embodiment.

FIG. 7 illustrates a method of active clearance management, according to one embodiment. FIG. 7 shows that the method includes determining an operation condition of the compressor 601, setting a clearance 602, and controlling a moveable bearing to move a rotor according to the set clearance 603. Determining an operation condition of the compressor 601 may further include sampling one or more temperatures of the compressor 606, determining whether the temperature of the compressor is higher than a threshold temperature 607, sampling one or more pressures of the compressor 608, determining whether the pressure or a pressure difference is higher than a threshold pressure 609, sampling a rotational speed of a rotor 611, and/or sampling a position of the rotor 612.

Figure 8:
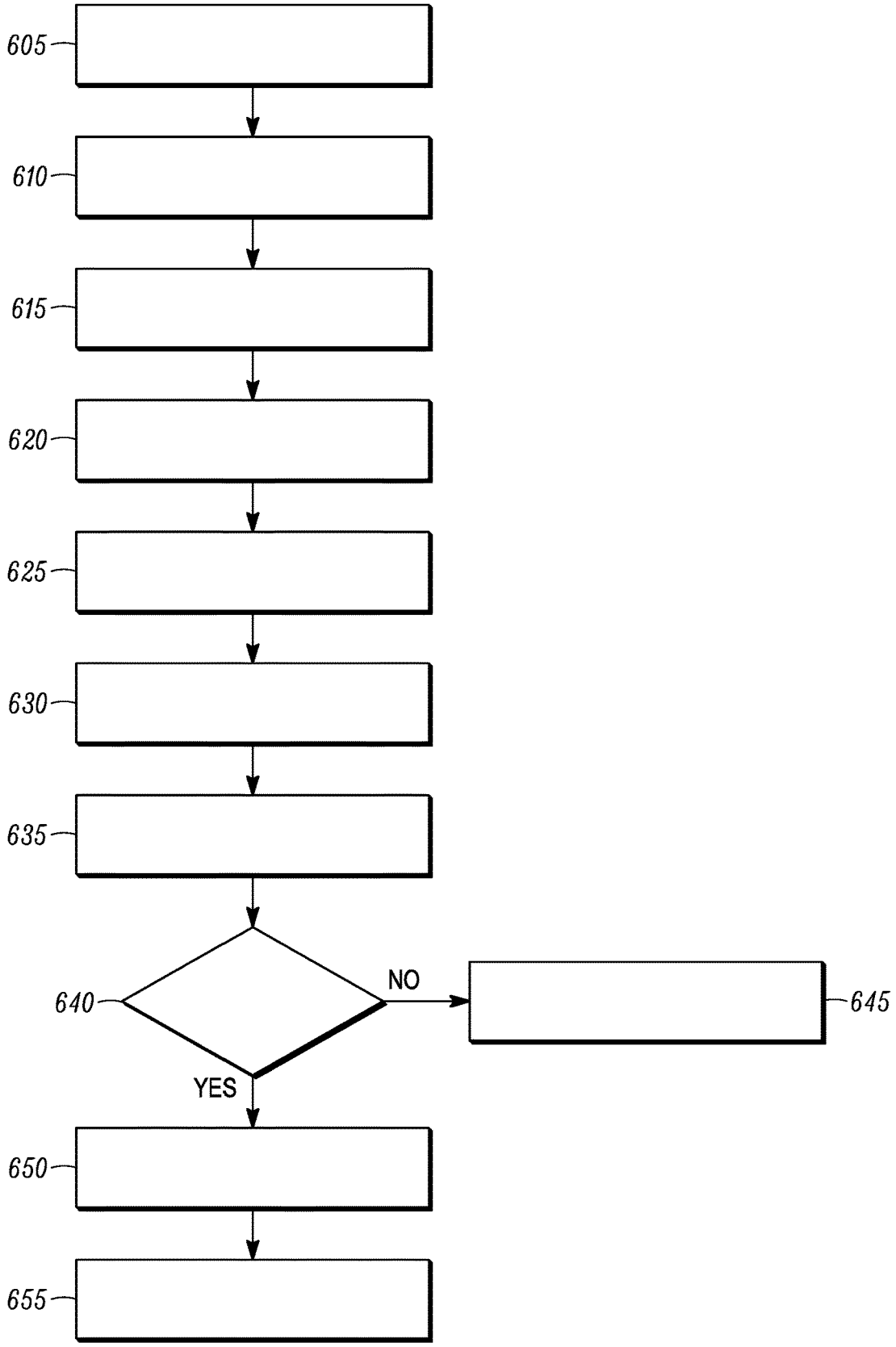
FIG. 8 illustrates a method of active clearance management, according to one embodiment.

FIG. 8 illustrates a method of active clearance management, according to one embodiment. FIG. 8 is a specific example of a start-up method and operation after start-up with active management of rotor clearances. The method in FIG. 8 includes levitating a compressor rotor 605 and calibrating a clearance of the compressor 610. Calibrating a clearance 610 is defined to obtain a current position of the rotor and calculating a maximum distance of a clearance. Different methods can be used to calibrate a clearance. One example of calibrating a clearance is to move one rotor of the compressor to touch another rotor of the compressor to measure a rotor-to-rotor clearance. Another example of calibrating a clearance is to move one rotor of the compressor to touch an interior surface of a bore of a compressor housing to measure a rotor-to-bore clearance. Yet another example of calibrating a clearance is to move one rotor of the compressor to touch an endplate of the compressor to measure a rotor-to-endplate clearance.

The method to actively manage a clearance further includes setting the clearance at a workable range for start-up 615; positioning a rotor to the set clearance 620; setting a rotation speed of a rotor 625; operating the rotor at the set rotation speed 630; sampling a temperature of the compressor 635; and determining whether the temperature of the compressor is higher than a threshold temperature 640. It is noted that 640 is not limited to sampling temperatures, 640 may also include sampling one or more pressures of the compressor 608, determining whether the pressure or a pressure difference is higher than a threshold pressure 609, sampling a rotational speed of a rotor 611, and/or sampling a position of the rotor 612. When the temperature is lower than the threshold temperature, maintain the clearance and the rotation speed 645. When the temperature is higher than the threshold temperature, change the clearance by repositioning the rotor 650. In one embodiment, the speed of the rotor is not changed, but in some embodiments, the speed of the rotor may be changed (at 655). It is noted that the temperature(s), the pressure(s), the rotation speed(s), the rotor position(s), or the like and the difference(s) thereof are all applicable to determining the operation conditions in this active clearance management method.

In one embodiment, the gap sensors of the magnetic bearing sample the position of the shaft at a frequency, wherein the frequency can be changed. The controller controls the controllable bearing according to the sampled positions.

In another embodiment, the controller controls the controllable bearing to move the shaft and/or rotor according to the measurement of temperature, pressure, and/or rotor position sensed by position sensors in addition to the position of the shaft sampled by the gap sensors.

In another embodiment, the measurement of temperature, pressure, and/or rotor position can be used by the controller directly to control the position of the shaft and/or rotor without the position of shaft sampled by the gap sensors.

Aspects. Any one of aspects of 1-10 are combinable with any one of aspects 11-18 and any one of aspects 19-26. Any of aspects 11-18 are combinable with any of aspects 19-26.

Aspect 1. A compressor, comprising:

a housing defining a working chamber, further comprising, a bore, and an endplate disposed toward a discharge end, a rotor having helical threads, the rotor being configured to be housed in the bore, a rotor clearance defined by an outer dimension of the rotor in relation to another static component in the compressor, a controllable bearing supporting the rotor, and a controller configured to control the controllable bearing such that the controllable bearing moves the rotor in a manner to reduce or enlarge the rotor clearance.

Aspect 2. The compressor according to aspect 1, wherein the rotor clearance includes one or more of a rotor-to-bore clearance defined between the rotor and an interior surface of the bore, and a rotor-to-endplate clearance defined between the rotor and the endplate.

Aspect 3. The compressor according to aspects 1 or 2, wherein the housing further includes a second bore;

the compressor further includes a second rotor disposed in the second bore, the second rotor has helical threads intermeshing with the helical threads of the rotor;

a rotor-to-rotor clearance is defined between the rotor and the second rotor; and the controller is configured to control the controllable bearing such that the controllable bearing moves the rotor in a manner to reduce or enlarge the rotor-to-rotor clearance.

Aspect 4. The compressor according to aspect 3, further including, a fixed bearing supporting the second rotor.

Aspect 5. The compressor according to aspect 3, further including, a second controllable bearing supporting the second rotor, the second controllable bearing being configured to be able to move the second rotor in a manner to reduce or enlarge the rotor-to-bore, rotor-to-endplate, and/or the rotor-to-rotor clearance while the compressor is functionally operating.

Aspect 6. The compressor according to aspect 5, wherein the second controllable bearing is a magnetic bearing.

Aspect 7. The compressor according to any one or more of aspects 3 to 6, wherein the housing includes an intake port disposed toward an opposite end from the discharge end, a discharge port disposed toward the discharge end, and a compression chamber defined by the helical threads of the rotor and the second rotor and an interior surface of the housing, the compression chamber being configured to move from the intake port to the discharge port when the rotors rotate, the compression chamber being configured to gradually reduce its volume when moving from the intake port to the discharge port, the compression chamber being configured to change its volume when any of the clearances are changed.

Aspect 8. The compressor according to any one or more of aspects 1 to 7, further including, a temperature sensor configured to sense a temperature of the compressor, wherein the controller is configured to change any of the clearances according to the temperature sensed by the temperature sensor.

Aspect 9. The compressor according to any one or more of aspects 1 to 8, further including, a position sensor configured to measure any of the clearances, wherein the controller is configured to change any of the clearances according to the clearance measured by the position sensor.

Aspect 10. The compressor according to any one or more of aspects 1 to 3 and 5 to 9, wherein the controllable bearing is a magnetic bearing.

Aspect 11. An HVAC system, comprising, a fluidically connected fluid circuit, further including, a condenser, an expansion device disposed downstream of the condenser, an evaporator disposed downstream of the expansion device, a compressor disposed downstream of the evaporator and upstream of the condenser, the compressor further including, a housing defining a working chamber, further including, two parallel intersecting bores, and an endplate disposed toward a high pressure end, two rotors having intermeshing helical threads, the rotors being configured to be housed in the bores, a first clearance defined between the two rotors, a second clearance defined between one of the rotors and an interior surface of the bores, a third clearance defined between one of the rotors and the endplate, a controllable bearing supporting one of the rotors, and a controller configured to control the controllable bearing such that the controllable bearing moves the rotor supported in a manner to reduce or enlarge the first, second, or third clearances.

Aspect 12. The HVAC system according to aspect 11, wherein the housing further includes, an intake port disposed toward an opposite end from the discharge end, a discharge port disposed toward the discharge end, and a compression chamber defined by the helical threads of the two rotors and an interior surface of the housing, the compression chamber being configured to move from the intake port to the discharge port when the rotors rotate, the compression chamber being configured to gradually reduce its volume when moving from the intake port to the discharge port, the compression chamber being configured to change its volume when any of the clearances are changed.

Aspect 13. The HVAC system according to aspect 11 or 12, wherein the compressor further includes, a temperature sensor configured to sense a temperature of the compressor, wherein the controller is configured to change a clearance according to the temperature sensed by the temperature sensor.

Aspect 14. The HVAC system according to any one or more of aspects 11 to 13, wherein the controllable bearing is a magnetic bearing.

Aspect 15. The HVAC system according to any one or more of aspects 11 to 14, wherein the compressor further includes, a first fixed bearing supporting the other rotor.

Aspect 16. The HVAC system according to any one or more of aspects 11 to 14, wherein the compressor further includes, a second controllable bearing supporting the other rotor, the second controllable bearing being configured to be able to move the rotor it supported in a manner to reduce or enlarge the first, second, and/or third clearance while the compressor is functionally operating.

Aspect 17. The HVAC system according to aspect 16, wherein the second controllable bearing is a magnetic bearing.

Aspect 18. The HVAC system according to any one or more of aspects 11 to 17, wherein the compressor further includes, a temperature sensor configured to sense a temperature of the compressor, and the controller is configured to control the controllable bearing to move one of the rotor according to the temperature sensed by the temperature sensor.

Aspect 19. A method to control a compressor, comprising, determining an operation condition of the compressor, setting a clearance, and controlling a moveable bearing to move a rotor according to the set clearance.

Aspect 20 The method to control a compressor according to aspect 19, wherein the moveable bearing is a magnetic bearing.

Aspect 21. The method to control a compressor according to aspect 19 or 20, wherein the step of determining an operation condition of the compressor further includes, sampling a temperature of the compressor, and determining whether the temperature of the compressor is higher than a threshold temperature.

Aspect 22. The method to control a compressor according to aspect 21, further including changing the clearance by repositioning the rotor, when the temperature is higher than the threshold temperature.

Aspect 23. The method to control a compressor according to any one or more of aspects 19 to 22, further including setting a rotation speed of a rotor, and operating the rotor at the set rotation speed.

Aspect 24. The method to control the compressor according to any one or more of aspects 19 to 23, further including, calibrating a clearance of the compressor, setting a clearance at a workable range for start-up, and positioning a rotor to the set clearance.

Aspect 25. The method to control the compressor according to aspect 24, wherein the step of calibrating the clearance of the compressor further includes, moving a rotor of the compressor to touch another rotor of the compressor to measure a rotor-to-rotor clearance, and/or moving a rotor of the compressor to touch an interior surface of a bore of a compressor housing to measure a rotor-to-bore clearance, and/or moving a rotor of the compressor to touch an endplate of the compressor to measure a rotor-to-endplate clearance.

Aspect 26. The method to control the compressor according to any one or more of aspects 19 to 25, further including changing the rotation speed of the rotor.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A heating, ventilation, and air conditioning (HVAC) system, comprising, a fluidically connected fluid circuit including, a condenser, an expansion device disposed downstream of the condenser, an evaporator disposed downstream of the expansion device, a compressor disposed downstream of the evaporator and upstream of the condenser, the compressor including, a housing, two bores within the housing, an endplate disposed toward a high pressure end, two rotors having intermeshing helical threads, each of the rotors being configured to be housed in one of the bores, a rotor-to-rotor clearance defined between the two rotors, a rotor-to-bore clearance defined between one of the rotors and an interior surface of the bores, a rotor-to-endplate clearance defined between the one of the rotors and the endplate, a controllable bearing supporting one of the two rotors, and a controller configured to control the controllable bearing such that the controllable bearing moves the one of the two rotors in a manner to reduce or enlarge the rotor-to-rotor, rotor-to-bore, or rotor-to-endplate clearances.

2. The HVAC system according to claim 1, wherein the housing further includes, an intake port disposed toward an opposite end from a discharge end, a discharge port disposed toward the discharge end, and a compression chamber defined by the helical threads of the two rotors and an interior surface of the housing, the compression chamber being configured to move from the intake port to the discharge port when the rotors rotate, the compression chamber being configured to gradually reduce its volume when moving from the intake port to the discharge port, the compression chamber being configured to change its volume when any one or more of the rotor-to-rotor, rotor-to-bore, and rotor-to endplate-clearances are changed.

3. The HVAC system according to claim 1, wherein the compressor further includes, a temperature sensor configured to sense a temperature of the compressor, wherein the controller is configured to change any one or more of the rotor-to-rotor, rotor-to-bore, and rotor-to-endplate clearances according to the temperature sensed by the temperature sensor.

4. The HVAC system according to claim 1, wherein the controllable bearing is a magnetic bearing.

5. The HVAC system according to claim 1, wherein the compressor further includes a first fixed bearing supporting the other of the two rotors.

6. The HVAC system according to claim 1, wherein the compressor further includes, a second controllable bearing supporting the other of the two rotors, the second controllable bearing being configured to be able to move the other of the two rotors in a manner to reduce or enlarge the rotor-to-rotor clearance, a rotor-to-bore clearance of the other of the two rotors, and/or a rotor-to-endplate clearance of the other of the two rotors.

7. The HVAC system according to claim 6, wherein the second controllable bearing is a magnetic bearing.

8. The HVAC system according to claim 1, wherein the compressor further includes, a temperature sensor configured to sense a temperature of the compressor, and the controller is configured to control the controllable bearing to move the one of the two rotors according to the temperature sensed by the temperature sensor.

* * * * *